US007278761B2

(12) United States Patent
Kuan

(10) Patent No.: US 7,278,761 B2
(45) Date of Patent: Oct. 9, 2007

(54) HEAT DISSIPATING POLE ILLUMINATION DEVICE

(75) Inventor: Hsin-Ning Kuan, Sinjhuang (TW)

(73) Assignee: Thermalking Technology International Co., Taipei (TW)

( * ) Notice: Subject to any disclaimer, the term of this patent is extended or adjusted under 35 U.S.C. 154(b) by 32 days.

(21) Appl. No.: 11/243,989

(22) Filed: Oct. 6, 2005

(65) Prior Publication Data

US 2007/0081338 A1 Apr. 12, 2007

(51) Int. Cl.
*F21V 29/00* (2006.01)

(52) U.S. Cl. ..... 362/294; 362/373; 362/431

(58) Field of Classification Search ..... 362/294, 362/480, 547, 218, 345, 800, 227, 431, 152, 362/153, 153.1, 264, 373, 183; 361/697
See application file for complete search history.

(56) References Cited

U.S. PATENT DOCUMENTS 5,136,493 A * 8/1992 Straus et al. ..... 362/373
2004/0120151 A1* 6/2004 Ostler et al. ..... 362/294
2006/0250803 A1* 11/2006 Chen ..... 362/373

* cited by examiner

*Primary Examiner*—Renee Luebke
*Assistant Examiner*—Kevin J. Spinella

(57) ABSTRACT

An illumination device includes a body. The inner space of the body is divided into two parts as a first part and a second part. A heat dissipating module is disposed in the first part. The second part is fully sealed so that dusts, water and insects may be kept off. A plurality of light emitting units are disposed in the second part so as to provide light. The light emitting units are connected with the heat dissipating module in the first part. Hence, heat generated by the light emitting units may be dissipated out of the body and so that the illumination device of the present invention may have a longer service life.

12 Claims, 8 Drawing Sheets

HEAT DISSIPATING POLE ILLUMINATION DEVICE

BACKGROUND OF THE INVENTION

1. Field of the Invention

The invention generally relates to an illumination device. More particularly, the invention relates to an illumination device of which a body is divided into a first part and a second part, and the second part, where light emitting units are disposed, is fully sealed so that dusts and water may be kept off; a heat dissipating module is disposed in the first part so that heat generated by the light emitting units can be dissipated out of the body so that the illumination device of the present invention will have a longer service life.

2. Description of the Prior Art

Illumination devices, including street lamps, yard lamps and other outdoor illumination devices have been indispensable to ensure the safety of people's homes and to keep thieves away and so that people can see in the night times. However, the conventional illumination devices have the following disadvantages:

1. Most of them use incandescent bulbs, mercury lights, sodium lights, etc., and hence they have a relatively lower efficiency in terms of the energy conversion from power to light and consume relatively more power. In addition, most of them use only AC and do not use DC or solar cell.

2. A cover is usually used to cover a light. To allow heat to dissipate, such cover is not fully sealed; hence, dusts, sands, water and insects may enter the cover quite easily. These dusts, water and insects soil the inner space of the cover and hence lessen the brightness.

3. No heat dissipating device is disposed in the illumination device. Hence, heat can not be swiftly dissipated and its service life is shortened.

Therefore, we can see that the illumination devices of the prior art have many disadvantages and need to be improved.

To eliminate the disadvantages of the prior art, the inventor has put in a lot of effort in the subject and has successfully come up with the illumination device of the present invention.

SUMMARY OF THE INVENTION

The present invention is to provide an illumination device that has a good heat dissipating design and can keep water and insects off as well as can prevent the occurrence of corrosion.

Another, the present invention is to provide an illumination device in which heat may be dissipated from its body to the ambient surrounding so as to lengthen its service life.

Still another, the present invention is to provide an illumination device in which DC from a solar cell and/or a DC power supply unit (which is able to convert AC to DC) may be used so that less power will be consumed.

The illumination device of the present invention includes a body. The body includes an upper cover, a transparent lower cover, a dividing plate, a power supply unit, a heat dissipating module and a heat conducting plate. A plurality of light emitting units are fitted onto the heat conducting plate. A plurality of venting slots are disposed on each side of the upper cover. The lower cover may engage with the upper cover in a very tight manner. The dividing plate is disposed between the upper cover and the lower cover and can divide the inner space of the body into two parts—a first part and a second part. The second part is fully sealed so as to keep dusts and water off as well as prevent the occurrence of corrosion. The light emitting units are disposed in the second part so as to provide light. The power supply unit is placed in the second part so as to provide power to the light emitting units. The heat dissipating module is disposed in the first part and is connected with the heat conducting plate.

Hence, heat generated by the light emitting units may be transmitted from the heat conducting plate to the heat dissipating module and then to the venting slots and be dissipated out of the body. Whence, the light emitting units will not be burned out due to excessive heat.

These features and advantages of the present invention will be fully understood and appreciated from the following detailed description of the accompanying Drawings.

DETAILED DESCRIPTION OF THE PREFERRED EMBODIMENT

Figure 1:
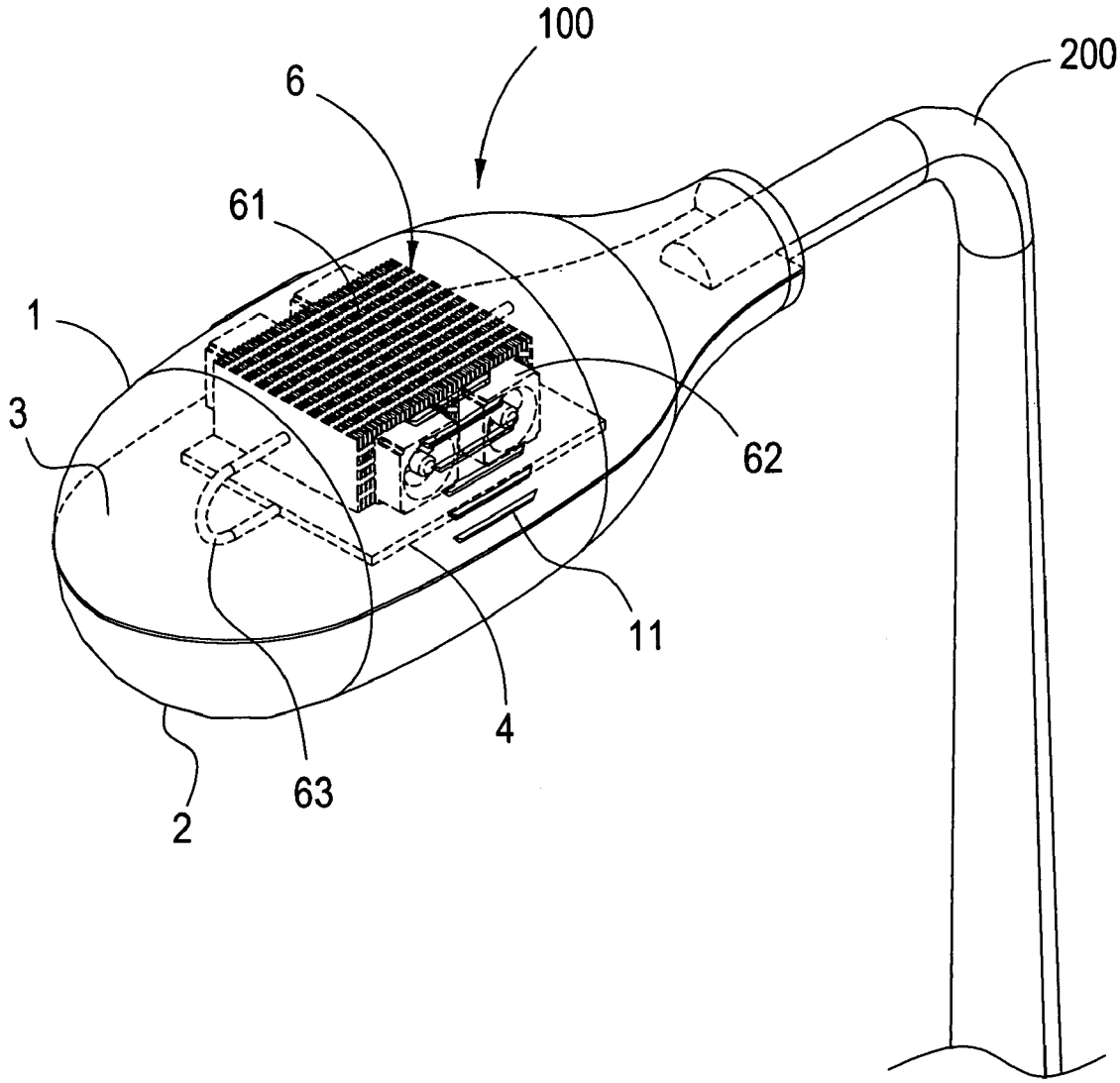
FIG. 1 is a perspective view showing an illumination device according to a first embodiment of the present invention.
Figure 2:
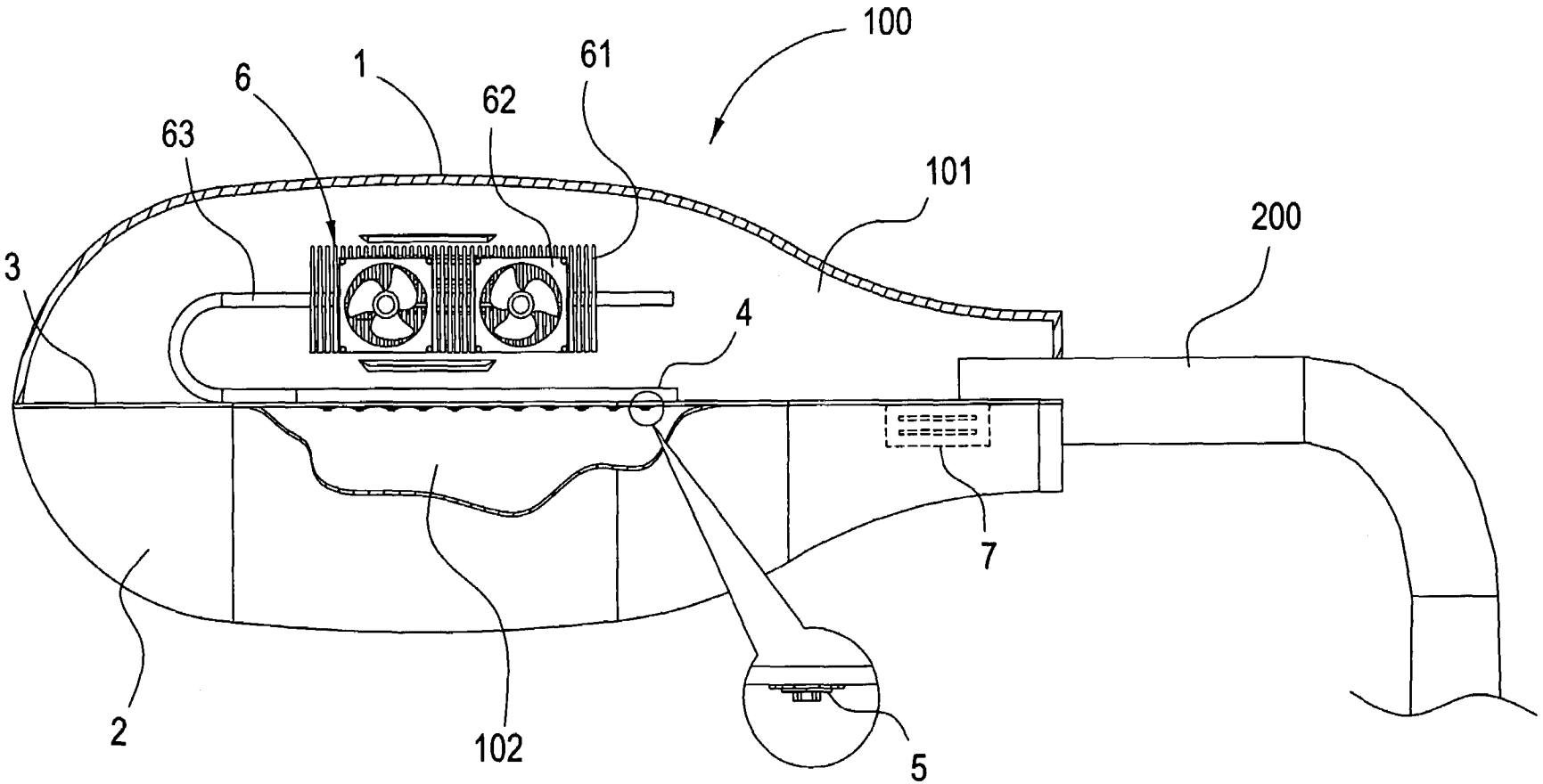
FIG. 2 is a sectional view showing the illumination device of FIG. 1.

Referring to FIGS. 1 and 2, an illumination device according to a first embodiment of the present invention is shown. The illumination device is shown as a street lamp. The illumination device comprises a body 100 and a pole 200. The body 100 includes an upper cover 1, a lower cover 2, a dividing plate 3, a heat conducting plate 4, at least a heat dissipating module 6 and a power supply unit 7.

A plurality of venting slots 11 are disposed on each side of the upper cover 1.

The lower cover is transparent and may engage with the upper cover 11 in a very tight manner.

An opening (not shown in the drawings) is provided in the dividing plate 3. The dividing plate 3 is disposed between the upper cover 1 and the lower cover 2 and can divide the inner space of the body 100 into two parts (a first part 101 and a second part 102); these two parts may be an upper part and a lower part or a front part and a rear part or a left part and a right part.

A plurality of light emitting units 5 are fitted on the underside of the heat conducting plate 4. These light emitting units 5 may be light emitting diodes or other bright light emitting units. The heat conducting plate 4 is fitted onto the opening of the dividing plate 3 in a very tight manner so that the second part 102 of the body 100 forms a fully sealed space so as to keep dusts, water and insects off. The light emitting units 5 extends into the second part 102 so as to send out light to the ambient surrounding.

The heat dissipating module 6 includes at least one set of heat dissipating fins 61, fan 62 and heat guiding piece 63. The fan 62 is disposed by the fins 61. The heat guiding piece 63 may have a U shape or a linear shape or an L shape; one end of the piece 63 is connected with the fins 61, and the other end is connected with a side wall of the heat conducting plate 4. The heat dissipating module 6 is disposed in the first part 101 of the body 100. The heat dissipating fins 61 may be disposed on the heat conducting plate 4.

The power supply unit 7 is disposed in the second part 103 of the body 100 so as to provide power to the light emitting units 5.

Figure 3A:
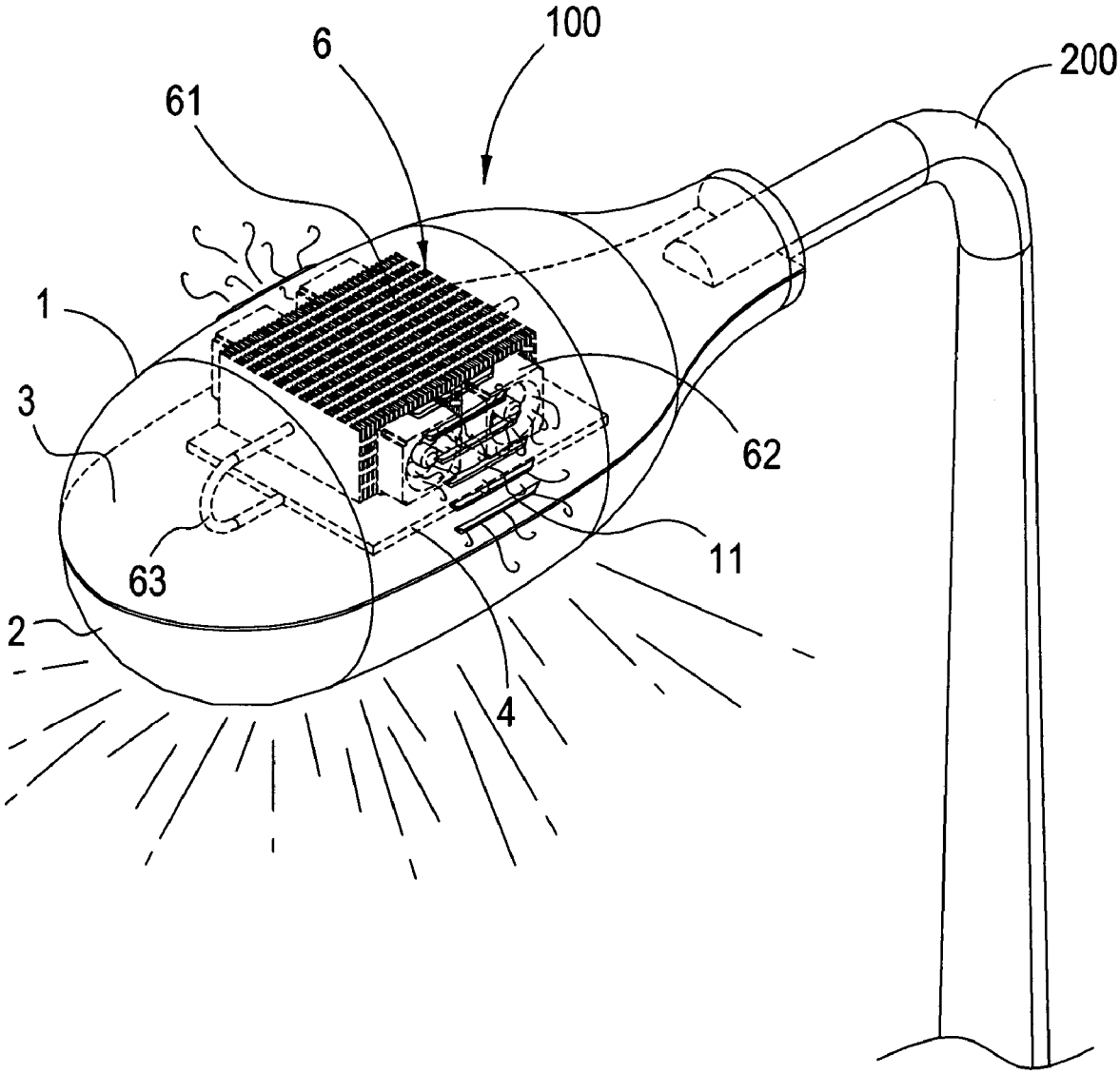
FIGS. 3A and 3B illustrate the illumination device of FIG. 1 in use.
Figure 3B:
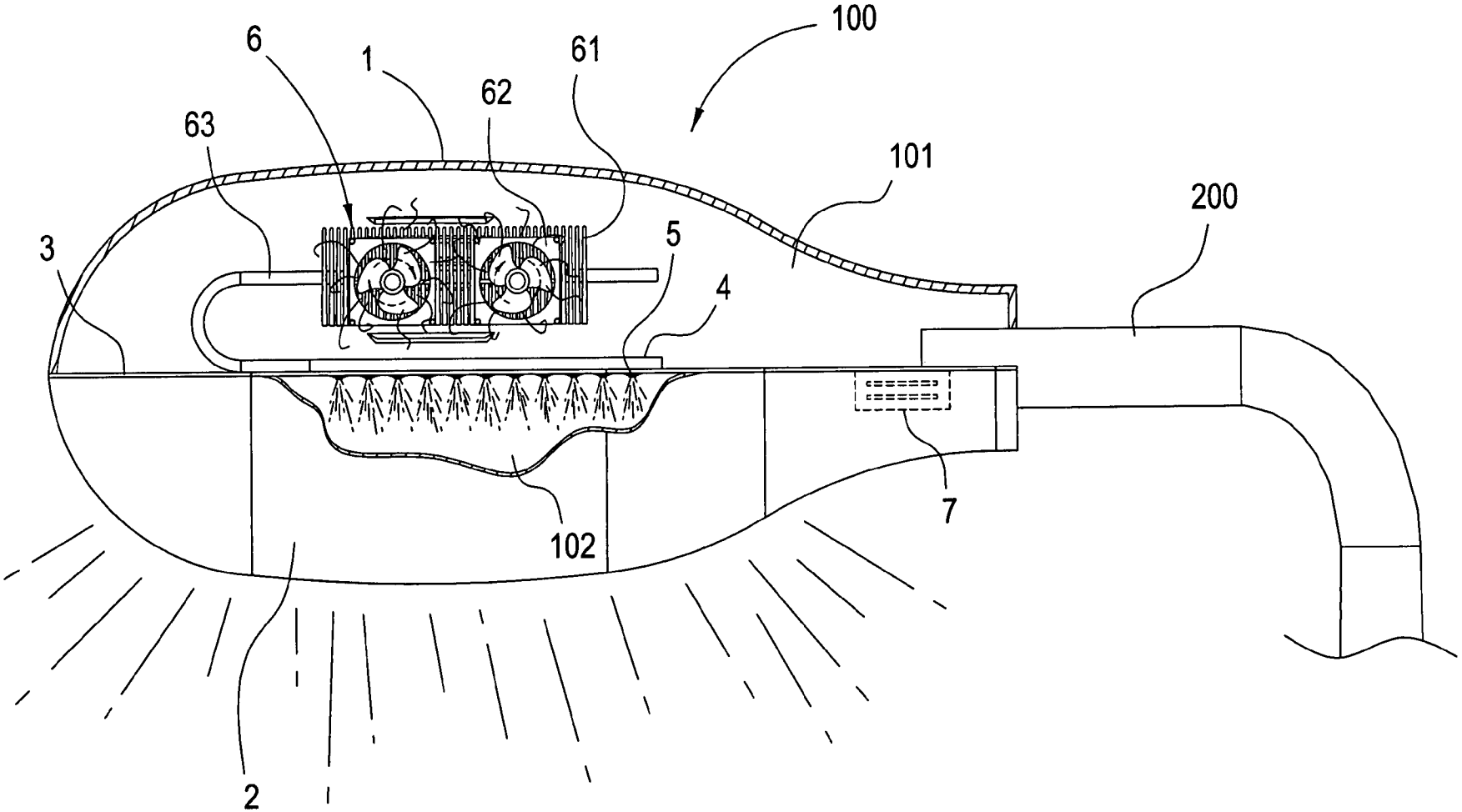

Referring to FIGS. 3A and 3B, the illumination device of FIG. 1 in use is shown. When the light emitting units 5 send out light, heat is generated; the heat is transmitted to the heat conducting plate 4; then heat is passed on to the heat dissipating fins 61 via the heat guiding piece 63. Heat is dissipated out of the body 100 through the fan 62 and the venting slots 11 so that the light emitting units 5 will not be burned out due to excessive heat. Also, because the second part 102 of the body 100 is fully sealed, dusts, water and insects are kept off and the second part 102 may be kept in a clean condition so that it will take a less amount of time or labor to clean the body 100.

Figure 4:
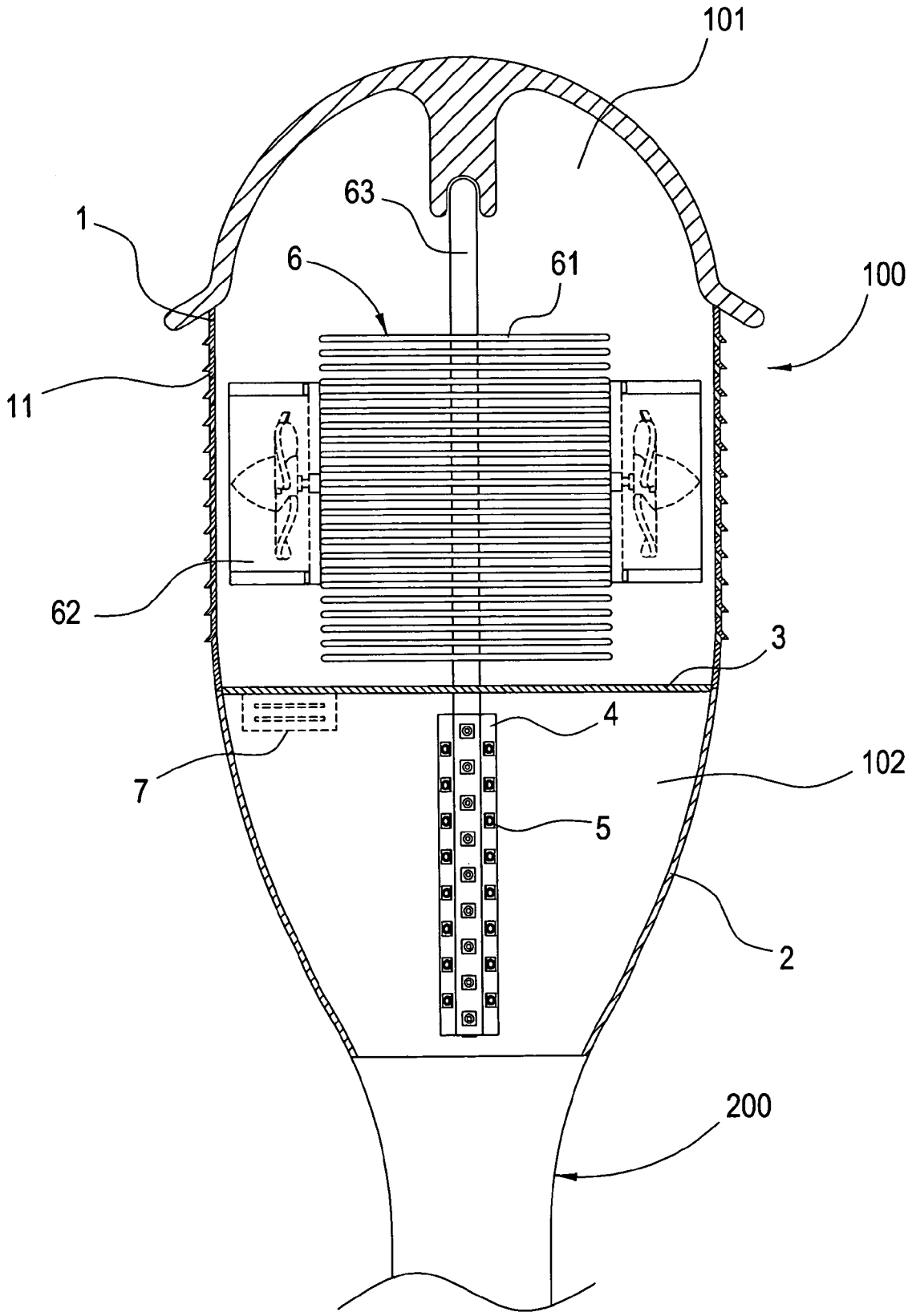
FIG. 4 is a sectional view of an illumination device according to a second embodiment of the present invention.
Figure 5:
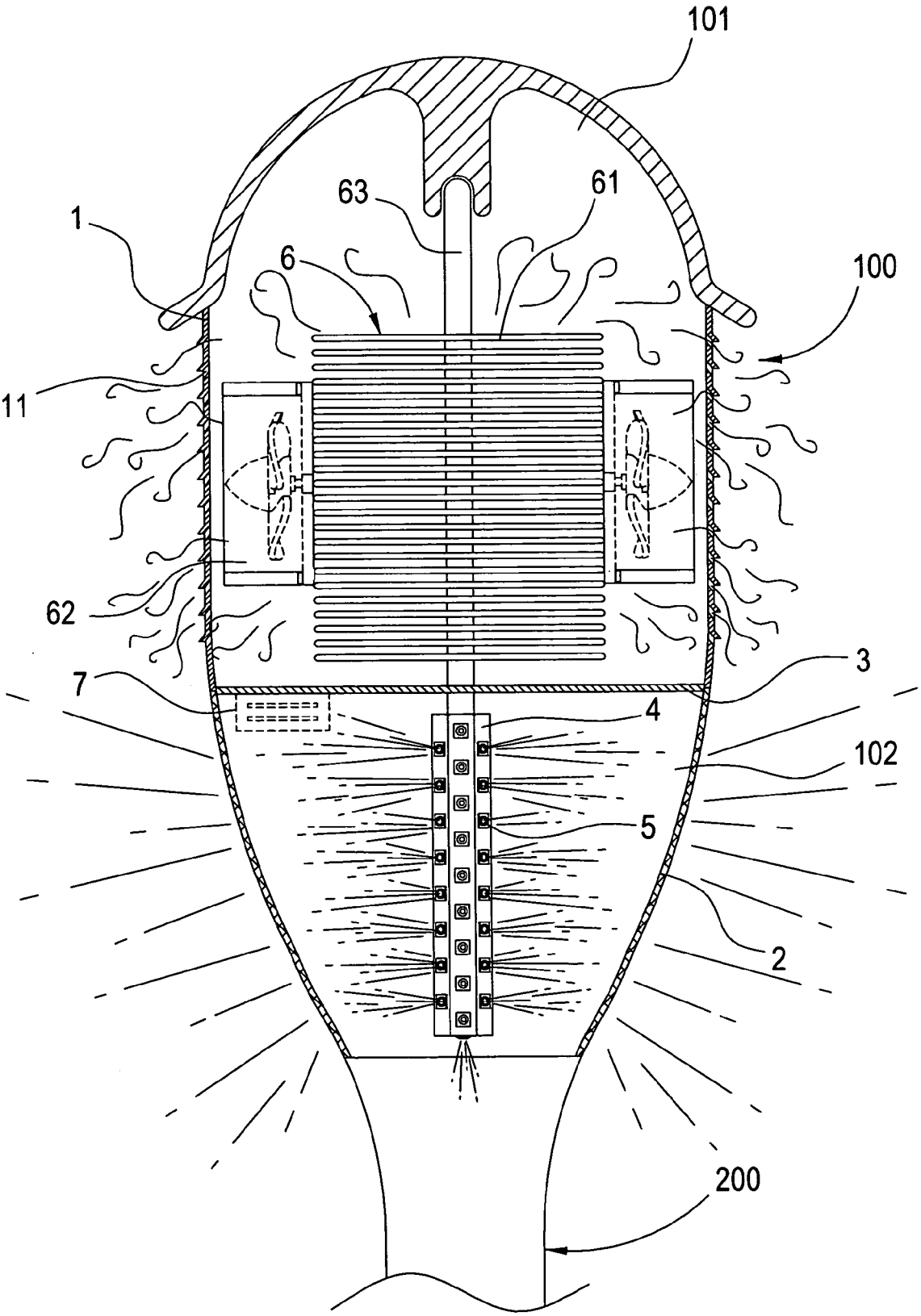
FIG. 5 illustrates the illumination device of FIG. 4 in use.
Figure 6:
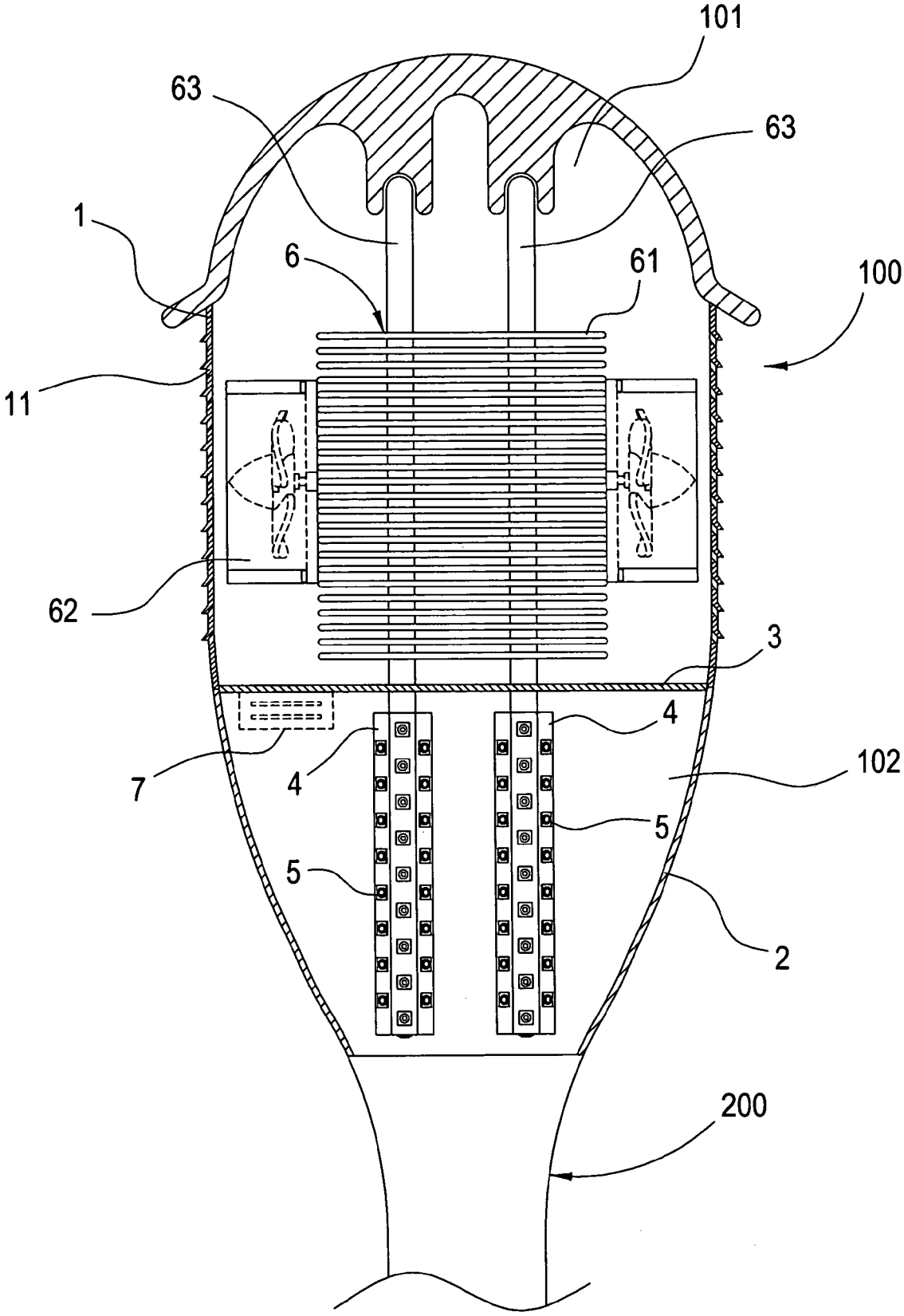
FIG. 6 is a sectional view of an illumination device according to a third embodiment of the present invention.
Figure 7:
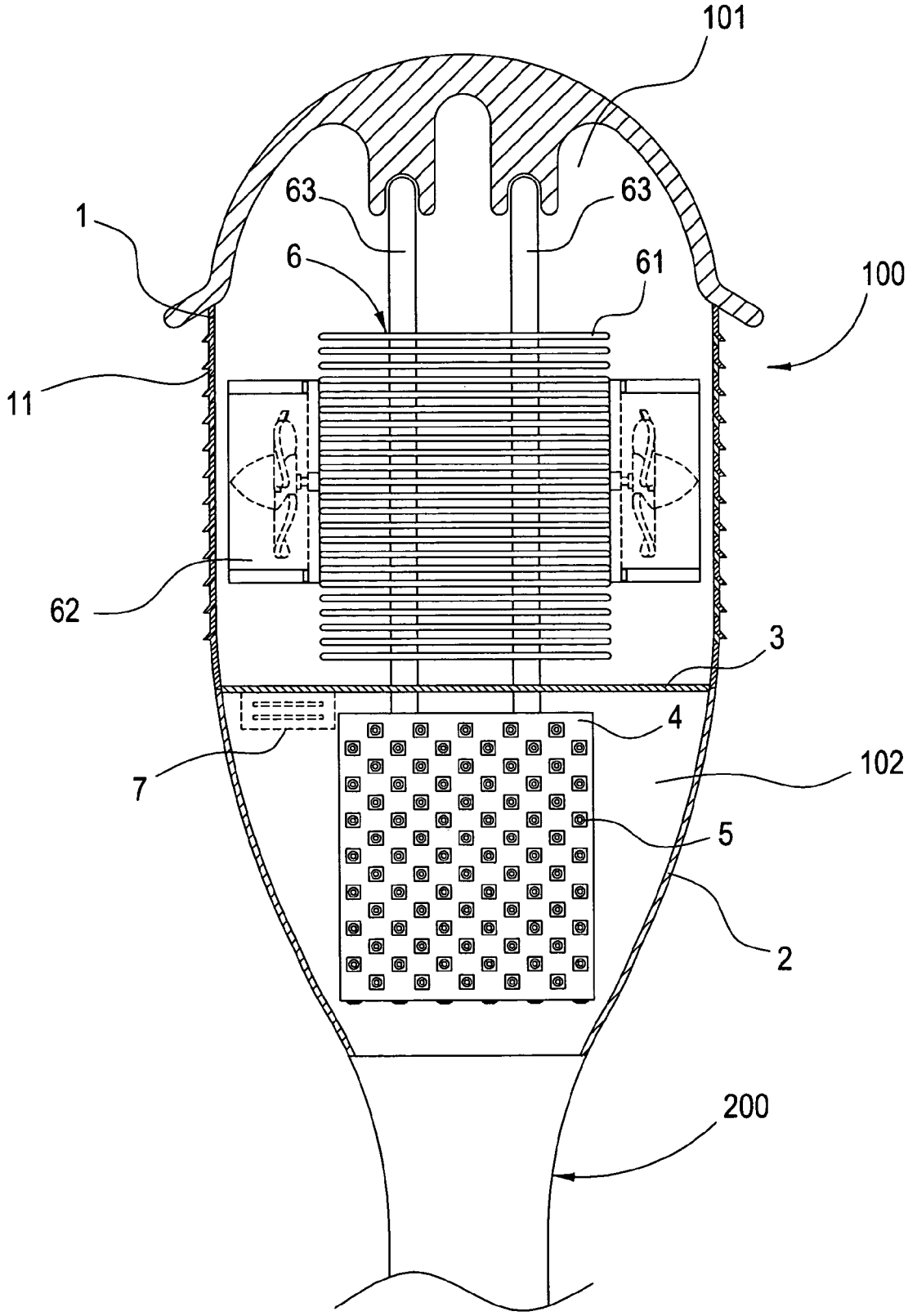
FIG. 7 is a sectional view of another example according to a third embodiment of the present invention.

Referring to FIG. 4, an illumination device according to a second embodiment of the present invention is shown. The illumination device is shown as a yard lamp. The illumination device comprises a body 100 and a pole 200. The body has a first part 101 and a second part 102. The first part 101 is open to the outside, while the second part 102 is fully sealed. A difference between the illumination device of the second embodiment and the illumination device of the first embodiment is that: in the former, the heat guiding piece 63 of the heat dissipating module 6 has a straight tabular shape, and a portion of the piece 63 extends into the second part 102. Also, a heat conducting plate 4 is disposed on the said portion of the piece 63. The cross section of the heat conducting plate 4 may be polygonal (as illustrated in FIG. 4) or rectangular (as illustrated in FIG. 5). A plurality of light emitting units 5 are fitted on each surface of the heat conducting plate 4 so that the light emitting units 5 may send out light in several directions. As illustrated in FIG. 7, when the light emitting units 5 send out light, heat is generated; the heat is transmitted to the heat conducting plate 4; then heat is passed on to the heat dissipating fins 61 via the heat guiding piece 63. Heat is dissipated to the ambient surrounding through the fan 62 and the venting slots 11 so that the light emitting units 5 will not be burned out due to excessive heat. In addition, as illustrated in FIGS. 6 and 7, two or more heat guiding pieces 63 may be used so that heat may be dissipated more quickly and more light emitting units 5 may be fitted.

The illumination device of the present invention has the following three advantages when compared to the illumination device of the prior art:

1. The inner space of the body is divided into two parts (a first part and a second part) by a dividing plate. The second part, which contains the light emitting units, is fully sealed so that dusts, water and insects may be kept off.

2. At least one set of heat dissipating fins, fan and heat guiding piece is disposed in the first part of the body so that heat generated by the light emitting units may be dissipated out of the body and so that the illumination device of the present invention may have a longer service life.

3. A power supply unit is disposed in the second part of the body so as to provide power to the light emitting units and so that no additional power is needed.

Although several preferred embodiments of the present invention have been described in detail hereinabove, it should be understood that many variations and modifications of the basic inventive concepts herein taught still fall within the scope of the present invention.

From the above, we can see that this invention is innovative in terms of design and has more advantages than the illumination device of the prior art. It is hoped that this patent application will be approved.

Many changes and modifications in the above described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A heating dissipating pole illumination device, comprising a body and an L-shaped pole connected with the body, wherein the body includes:

an upper cover;

a lower cover, which is transparent and engaged with the upper cover in a very tight manner;

a dividing plate, which is disposed between the upper cover and the lower cover to divide an inner space of the body into two parts as a first part formed in the upper cover and a second part formed in the lower cover;

a heat conducting plate, which is fitted onto an opening of the dividing plate and extends into the second part;

a plurality of light emitting units located in the second part, which are fitted on a bottom Surface of the heat conducting plate;

a heat dissipating module located in the first part, which is disposed above a top surface of the heat conducting plate; and a heat guiding piece with one end connected to the heat conducting plate and the other end connected to the heat dissipating module so that heat generated by the light emitting units is transmitted to the heat dissipating module and is dissipated out of the body.

2. The heating dissipating pole illumination device as in claim 1, wherein a plurality of venting slots are formed on each side of the upper cover.

3. The heating dissipating pole illumination device as in claim 1, wherein the heat dissipating module includes at least one set of heat dissipating fins and a fan and wherein one end of the heat guiding piece is connected with the heat conducting plate and the other end is penetrated through the heat dissipating fins, the fan being disposed to the heat dissipating fins.

4. The heating dissipating pole illumination device as in claim 3, wherein the heat guiding piece has an U shape.

5. The heating dissipating pole illumination device as in claim 1, wherein the light emitting units are light emitting diodes.

6. A heating dissipating pole illumination device, comprising a body and a straight pole connected with the body at top, wherein the body includes:

an upper cover;

a lower cover, which is transparent and engaged with the upper cover in a very tight manner;

a dividing plate, which is disposed between the upper cover and the lower cover to divide an inner space of the body into two parts as a first part formed in the upper cover and a second part formed in the lower cover;

a heat guiding piece penetrated through the dividing plate to have one end extended into the first part and the other end into the second part a heat dissipating module, which is disposed in the first part to be mounted on the heat guiding piece;

a heat conducting plate, which is disposed in the second part to be mounted on the heat guiding piece; and a plurality of light emitting units, which are fitted on the heat conducting plate so that heat generated by the light emitting units is transmitted via the heat guiding piece to the heat dissipating module and then is dissipated out of the body.

7. The heating dissipating pole illumination device as in claim 6, wherein the heat guiding piece has a straight tabular shape.

8. The heating dissipating pole illumination device as in claim 6, wherein the heat dissipating module includes at least one set of heat dissipating fins and a fan and wherein the heat guiding piece is penetrated through the heat dissipating fins, the fan being disposed to the heat dissipating fins.

9. The heating dissipating pole illumination device as in claim 8, wherein the heat dissipating module includes two or more sets of heat dissipating fins and fans.

10. The heating dissipating pole illumination device as in claim 6, wherein a cross section of the heat conducting plate is polygonal or rectangular.

11. The heating dissipating pole illumination device as in claim 6, wherein the light emitting units are light emitting diodes.

12. The heating dissipating pole illumination device as in claim 6, wherein a plurality of venting slots are provided on each side of the upper cover.

* * * * *